US005998771A

United States Patent [19]

Mariano et al.

[11] Patent Number: 5,998,771

[45] Date of Patent: Dec. 7, 1999

[54] HEAT DISPENSING BALL CADDY

[76] Inventors: Dominic J. Mariano, 32 Gail Dr., Naugatuck, Conn. 06770; Richard A. MacLennan, 8 Meeting House Rd., Haddam, Conn. 06438

[21] Appl. No.: 09/072,516

[22] Filed: May 4, 1998

Related U.S. Application Data

[60] Provisional application No. 60/066,883, Nov. 25, 1997.

[51] Int. Cl.[6] ..... H05B 3/34

[52] U.S. Cl. ..... 219/528; 219/759; 224/251

[58] Field of Search ..... 219/759, 756, 219/385, 386, 520, 521, 528, 529, 531, 552, 553, 530; 392/339, 344, 346; 126/263.01, 681; 224/251, 674, 679

[56] References Cited

U.S. PATENT DOCUMENTS

| | | | |
|---|---|---|---|
| 3,831,001 | 8/1974 | Toomey et al. . | |
| 4,155,002 | 5/1979 | Cohen . | |
| 4,967,062 | 10/1990 | Cohen . | |
| 5,137,011 | 8/1992 | Roth . | |
| 5,211,949 | 5/1993 | Salyer | 424/402 |
| 5,460,160 | 10/1995 | Parrott . | |
| 5,750,962 | 5/1998 | Hyatt | 219/528 |
| 5,875,646 | 3/1999 | Rich | 62/457.3 |
| 5,884,006 | 3/1999 | Frohlich et al. | 392/339 |

*Primary Examiner*—Tu Ba Hoang
*Attorney, Agent, or Firm*—Thomas J. Tighe

[57] ABSTRACT

A ball pouch has a hollow defined by walls comprising a plurality of linked cells packed with a heat storage medium. The medium is a mix including phase change material ("PCM") having a phase change temperature within the preferred range of 130–150° F. Preferably the PCM mix is in free-flowing powder or gel form, and includes paraffin, ultra fine silica, and an ingredient to convert microwaves, as from a microwave oven, into heat. The pouch is charged by heat soaking it, preferably in a microwave oven, until the PCM has fully absorbed its latent heat of fusion. A golf ball pouch according to this invention can be packed with a plurality of golf balls. Once charged the pouch heats golf balls contained therein to a desired temperature above ambient and keeps them well above ambient for more time than it takes to play a round of golf. The temperature to which the balls are heated depends on the phase change temperature of the selected PCM mix. The pouch is preferably snugly enclosed in a flexible, insulated container to reduce the rate of heat loss from the pouch, thus keeping the balls warmer for a longer time. The combination pouch and pouch container comprises the ball caddy of this invention.

17 Claims, 4 Drawing Sheets

HEAT DISPENSING BALL CADDY

This application claims the benefit of U.S. Provisional Application No. 60/066,883, filed Nov. 25, 1997.

BACKGROUND OF THE INVENTION

This invention relates in general to the field of containers for transporting and dispensing pre-stored heat to balls used in impact sports, e.g. golf balls, at a temperature elevated above ambient during play, and more particularly to such containers which use "phase change materials" (as defined below) for storing latent heat of fusion and subsequently dispensing same to the balls by undergoing a phase change.

Golf balls are designed to achieve maximum flight distances when struck by a golf club. It has been found that the temperature of a golf ball affects its ability to rebound from a club face. In other words, the temperature of a ball affects the distance it travels, and increased flight distances can be achieved by heating a golf ball to elevated temperatures. For example, if a given impact force would carry a golf ball at 75° Fahrenheit (F) 220 yards, the same impact could be expected to carry a golf ball at 105° F. about 226 yards. This is an increase of six yards as a result of the higher temperature.

While the rules of the Professional Golfing Association (PGA) do not prevent a golfer from using a heated golf ball, it is impossible to keep a ball warm while it is in play. And even if a golfer starts out with a plurality of heated golf balls to replace those that get cold, it would be very difficult to maintain a set of balls at an elevated temperature over the course of eighteen holes. Even heated balls carried in a container having walls of one-half inch thick polyurethane foam insulation will rapidly lose their heat, generally within an hour.

The desire to play with heated golf balls has fostered a variety of methods and devices for heating balls on the course, for example: using the exhaust of a gasoline powered golf cart; using resistance heating powered by a golf cart's battery; using resistance heating powered by a portable battery; using hot air circulating from a cart's heater; and non-rechargeable, chemically activated, heating elements. These methods all require that heat sources be carried or stationed around a course, and it is against PGA rules to use a handwarmer or other device for the purpose of heating a ball during play.

This invention solves the above-described problems. This invention provides a ball caddy for transporting a plurality of pre-heated balls which drastically reduces heat loss such that golf balls contained therein can be kept at a significantly elevated temperature even during the time it takes to play eighteen holes, thus enabling a golfer to start each hole with a heated golf ball. The caddy is insulated and includes a ball pouch which has reusable, environmentally safe, phase change material ("PCM") incorporated in its walls.

Phase change material or PCM derives its name from its ability to absorb, or release, substantial amounts of heat at a relatively constant temperature during changes in phase, such as when it changes from a solid to a liquid, or from a liquid to a solid, respectively. The amount of heat a PCM must absorb to change from a solid to a liquid, or release to change from a liquid to a solid, is called the its latent heat of fusion which is substantially greater than the sensible heat capacity of the material. While most materials generally absorb or give up heat linearly with a rise or decrease, respectively, in the surrounding temperature, this is not true when a change in phase occurs. For example, to change a material from a solid phase to a liquid phase, a considerable amount of heat, its latent heat of fusion, must be added to the material. While heat is being added to the material its temperature will rise generally proportionally to the rate at which heat is being added. However once the temperature of the solid reaches its melting, or phase change point, its temperature will not change significantly so long as any of the material remains solid. Only after generally all the material has melted, i.e. changed into its liquid phase, will the temperature of the material again start to rise generally linearly with the absorption of additional heat.

Likewise, a liquid material will radiate or give up heat as it cools, but once it reaches its freezing temperature, the temperature of the material will not significantly change until all of the material has frozen. i.e. changed in phase to a solid. (As used in this document, the term "freezing temperature" does not necessarily refer to the freezing temperature of water, but rather shall mean a temperature at which a subject material changes phase from a liquid to a solid.) In other words, the material will remain generally at its freezing temperature until it has lost its latent heat of fusion, at which point all the liquid has changed to its solid phase.

U.S. Pat. No. 5,211,949 by Salyer describes PCM combinations that are dry powder mixes above and below the phase change temperature of the PCM, and PCM gels. It also discloses use of waxes as PCMs.

The PCM mix used in this invention can be in powder or gel form, and can also be compounded to have usable freezing temperatures in a wide range above a comfortable outdoor ambient temperature. PCM is well suited for this application because upon heating or freezing, per weight, a PCM absorbs or releases substantially more energy than a sensible heat storage material which is heated or cooled to the same temperature range. In addition to their latent heat storage capacity, the PCMs of this invention also store and release sensible heat. Thus the latent storage is augmented to a significant extent by the PCMs' sensible heat storage capacity.

Also, extreme cold adversely affects carry distance for all constructions of golf balls. The feel of the ball becomes dramatically harder. This invention can be used to prevent even unheated balls from cooling to ambient temperature when it is adversely low.

Other advantages and attributes of this invention will be readily discernable upon a reading of the text hereinafter.

SUMMARY OF THE INVENTION

An object of this invention is to provide a portable, heat-storing ball caddy for dispensing pre-stored heat to a plurality of balls.

An additional object of this invention is to provide such a ball caddy capable of warming a plurality of balls contained therein to a temperature above the ambient temperature.

An additional object of this invention is to provide a lightweight, portable golf ball caddy capable of maintaining a plurality of golf balls contained therein at a temperature above the ambient temperature long enough to play a round of golf.

An additional object of this invention is to provide a golf ball caddy which makes use of phase change material to heat a plurality of golf balls to a desired temperature.

An additional object of this invention is to provide a golf ball caddy which makes use of phase change material to reduce the heat loss of a plurality of golf balls contained therein.

An additional object of this invention is to provide a golf ball caddy, as described above, which includes a pre-charged PCM walled pouch into which the golf balls are placed, and an insulated container for carrying the pouch to reduce the rate of heat loss from the pouch.

A further object of this invention is to provide a golf ball caddy, described above, capable of being conveniently stored in a pocket of a golf bag, or easily attached to such bag.

These objects, and other objects expressed or implied in this document, are accomplished by a heat dispensing ball caddy having a compliant medium for storing a latent heat of fusion, and a closable pouch having compliant walls packed with the medium for surrounding a plurality of balls, the compliant walls dispensing heat primarily when the medium undergoes a phase change. The caddy can further include a thermally insulated, closable container for immediately enclosing the pouch to prolong the dispensing of heat. Preferably the pouch walls are a plurality of uniform cells containing the medium. Preferably the walls quilted to define the cells and to keep the medium, which can be a powder or gel, from unevenly redistributing itself. Preferably the medium is a paraffin-based, microwave-chargeable PCM, and for golf ball applications, the medium has a preferable phase change temperature in the range of 130°–150° F., or optimally at about 147° F.

DESCRIPTION OF THE PREFERRED EMBODIMENT

Figures 1, 2, 3, 4:
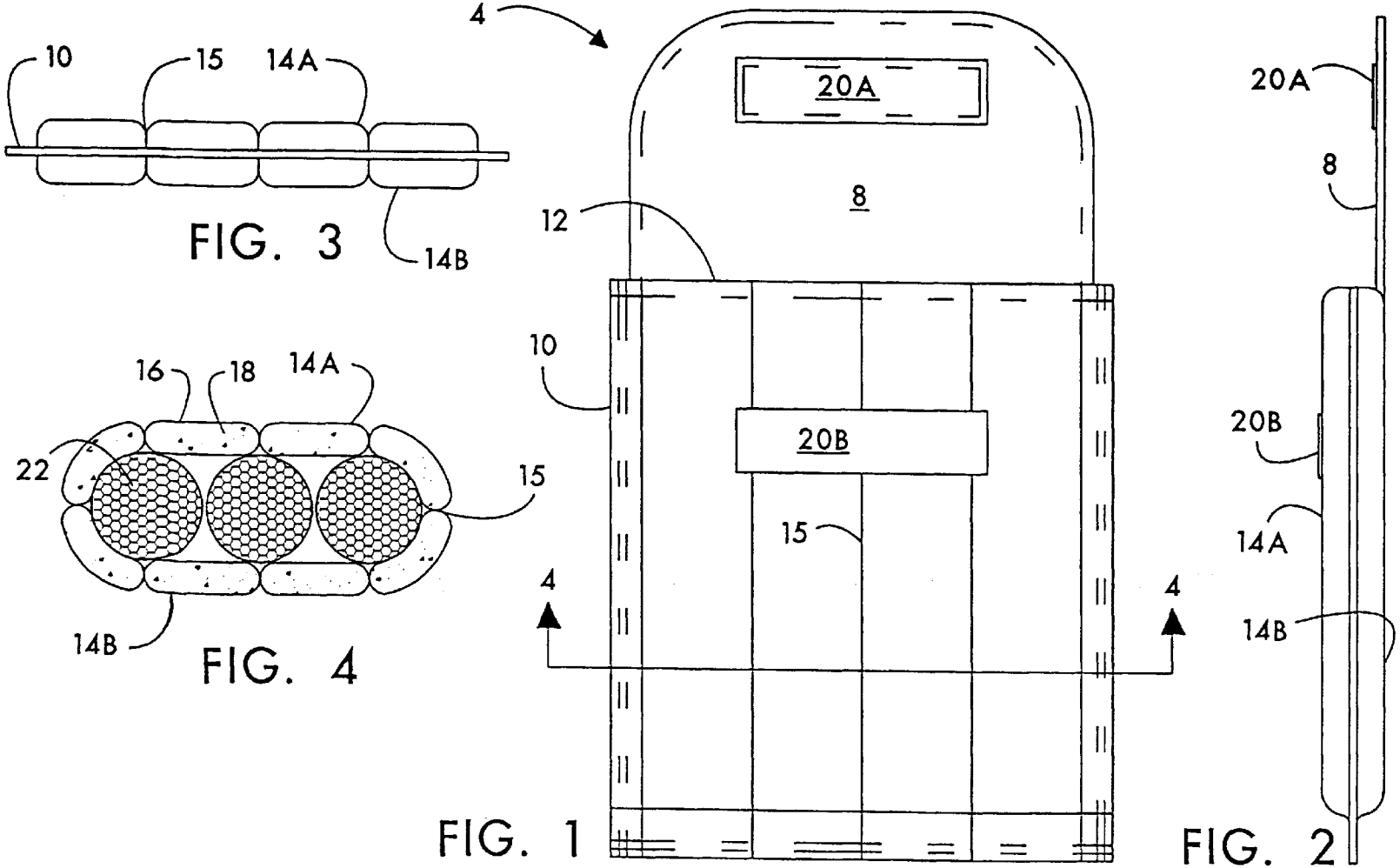
FIG. 1 is a front elevational view of a ball pouch according to this invention.
FIG. 2 is a side elevational view of the ball pouch according to this invention.
FIG. 3 is an end elevational view of the ball pouch according to this invention.
FIG. 4 is a cross-sectional view of the pouch containing golf balls, taken along line 4—4 of FIG. 1.

Referring to FIGS. 1–4 and 7–9, the heat retaining ball caddy of this invention, generally designated by the numeral 2, includes a ball pouch 4 carried within an insulated container 6. The pouch has a flap 8 attached to a hollow body 10 along one edge of an opening 12 through which golf balls are inserted into the hollow. The pouch, when filled with balls and closed, fits snugly inside the container, and for golf balls, the pouch and container are sized to be carried in the pocket of a golf bag. The pouch can be fabricated from any strong, flexible material, preferably a fine meshed nylon fabric or equivalent which is capable of containing the PCM mix and withstanding the "charging" (as defined below) temperatures of the PCM. The generally rectangular-shaped body 10 of the pouch has two opposing walls, 14A and 14B, each having a plurality of elongated cells 16 filled with PCM 18. Preferably the cells of each wall are defined by two fabric sheets having spaced, parallel, longitudinal seams 15 with cell gaps between adjacent seams, much like the elongated insulation-filled pockets of a quilt. The quilted walls, 14A and 14B, are joined along three margins preferably by stitching or such, leaving one margin unseamed to form the opening 12. The flap 8 is preferably an unquilted extension of one of the walls 14B. Releasable fasteners, 20A and 20B, preferably opposing strips of hook and loop fasteners, are attached respectively on the inside of the flap and on the outside of the opposite wall, both disposed so as to align when the flap is folded over the wall. A plurality of balls 22 can be placed in the hollow of the pouch, where they can be enclosed and secured by the flap.

Referring to FIG. 4, the plurality of cells 16 for containing the PCM mix 18 prevents the mix from shifting, keeping the mix in a uniform cross-section along the length of the cells. Since the preferred PCM mix is a powder or gel material, the pouch walls, 14A and 14B, are still flexible when the cells are packed with the PCM mix. While there is no PCM mix at the seams of the cells, the fullness and flexibility of the cells causes adjoining cells to abut across separating seams, especially when the pouch contains balls, as best shown in FIG. 4. This minimizes heat loss at the cell seams. When the pouch is not filled with balls, the flexibility and the weight of the PCM mix causes the pouch walls conform around any balls therein, thus increasing the surface area of the balls in contact with the PCM cells.

The preferred PCM composite used for this invention includes paraffin having a melting, i.e. phase change, temperature of approximately 147° F. combined with ultra fine particles of silica as a matrix or carrier. The phase change temperature should be above the desired storage temperature and 147° F. has been found to be advantageous for golf balls stored in a ball caddy according to this invention. A mix having about 75% paraffin and 25% silica (weight) is a free-flowing powder above and below the melting temperature of the paraffin. At ratios of 90%/10%–85%/15% PCM/silica the combination is a gel. The PCM composite also includes a polar ingredient as an "antenna" for converting microwaves to heat, e.g. carbon black, glycerine, glycol or IVORY soap.

In operation, prior to packing balls in the pouch, the pouch is "charged" by heating the pouch to at least the PCM's phase change temperature and letting it soak long enough for the PCM to absorb and store its latent heat of fusion, and preferably some sensible heat. It has been found that a golf ball pouch according to this invention can be sufficiently charged by subjecting it to microwaves it in a microwave oven for a short time, approximately three minutes; this time is normally sufficient to convert the paraffin particles, or other phase change material, within the pouch to a liquid phase. Thus the pouch PCM will have absorbed its latent heat of fusion and will be at a temperature above the ambient temperature, depending upon the compounding of the PCM, preferably in the range of 130–150° F. However lower or higher temperatures can also be used and achieved by using other kinds of paraffin (paraffins are available with melting points which range from about 5° F. to about 300° F.) or other kinds of PCM in the pouch.

After the pouch has been charged, the balls can then be packed into it. The pouch is then closed and sealed by closing its flap 8. The balls in the pouch will then be warmed by the heat emanating from the PCM. It has been found that it takes about 30 minutes in a charged pouch to warm a golf ball to a desired playing temperature. To slow the rate of phase change, and thus prolong the dispensing of heat to the balls, the pouch is preferably placed into the above-described thermally insulated container. As explained above, the container is preferably dimensioned to snugly contain a ball-packed pouch so as to trap the released heat immediately around the PCM cells to slow the rate of the phase change. The container can be any well insulated container, but is preferably a light-weight, flexible, foam-insulated, "lunch box" style container. Such a container can easily be packed into odd-shaped, cramped spaces, such as the pocket of a golf bag, and still maintain its insulating ability.

Figure 8:
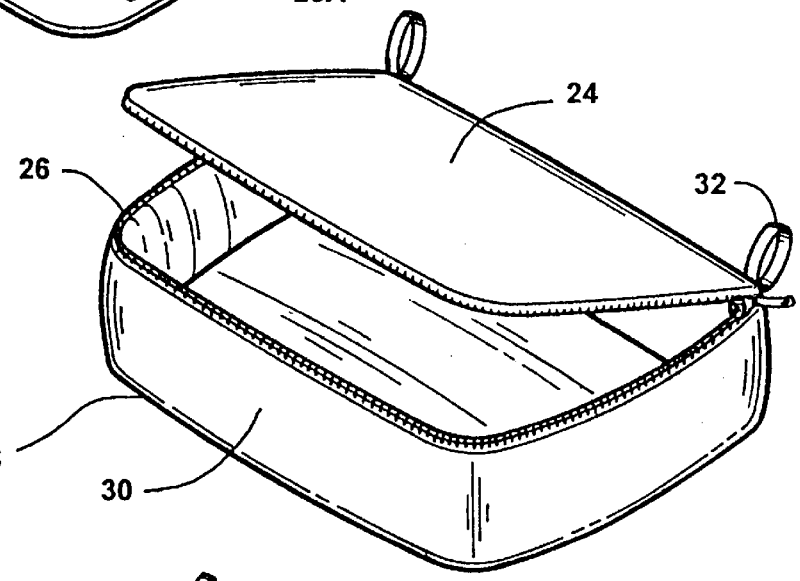
FIG. 8 is a pictorial view of an open pouch container according to this invention.
Figure 9:
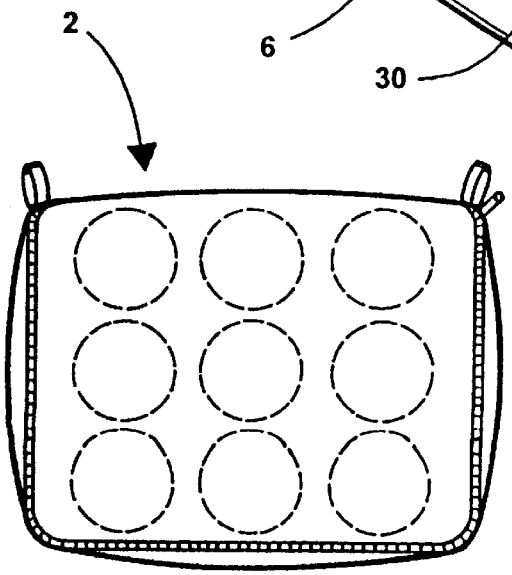
FIG. 9 is a top view of a closed pouch container holding a pouch with a plurality of golf balls stored within.

Referring to FIGS. 8 and 9, the insulated container 6 has a lid 24 foldably attached along the top of one side. The lid is closed along the top edges of the remaining sides by a zipper 26 or equivalent means of closure. The container walls and cover are preferably polyurethane foam, approximately one-half inch thick, covered by a strong fabric 30, such as nylon, and stitched together at seams. The corners of the container are slightly rounded and the surfaces bulge slightly because of the insulation contained within the fabric covers. Loops 32, attached near the corners of the container where the lid is foldably attached can be used for securing the container to other objects, such as a golf bag, or may be slipped over a belt to allow it to be easily carried.

Figure 6:
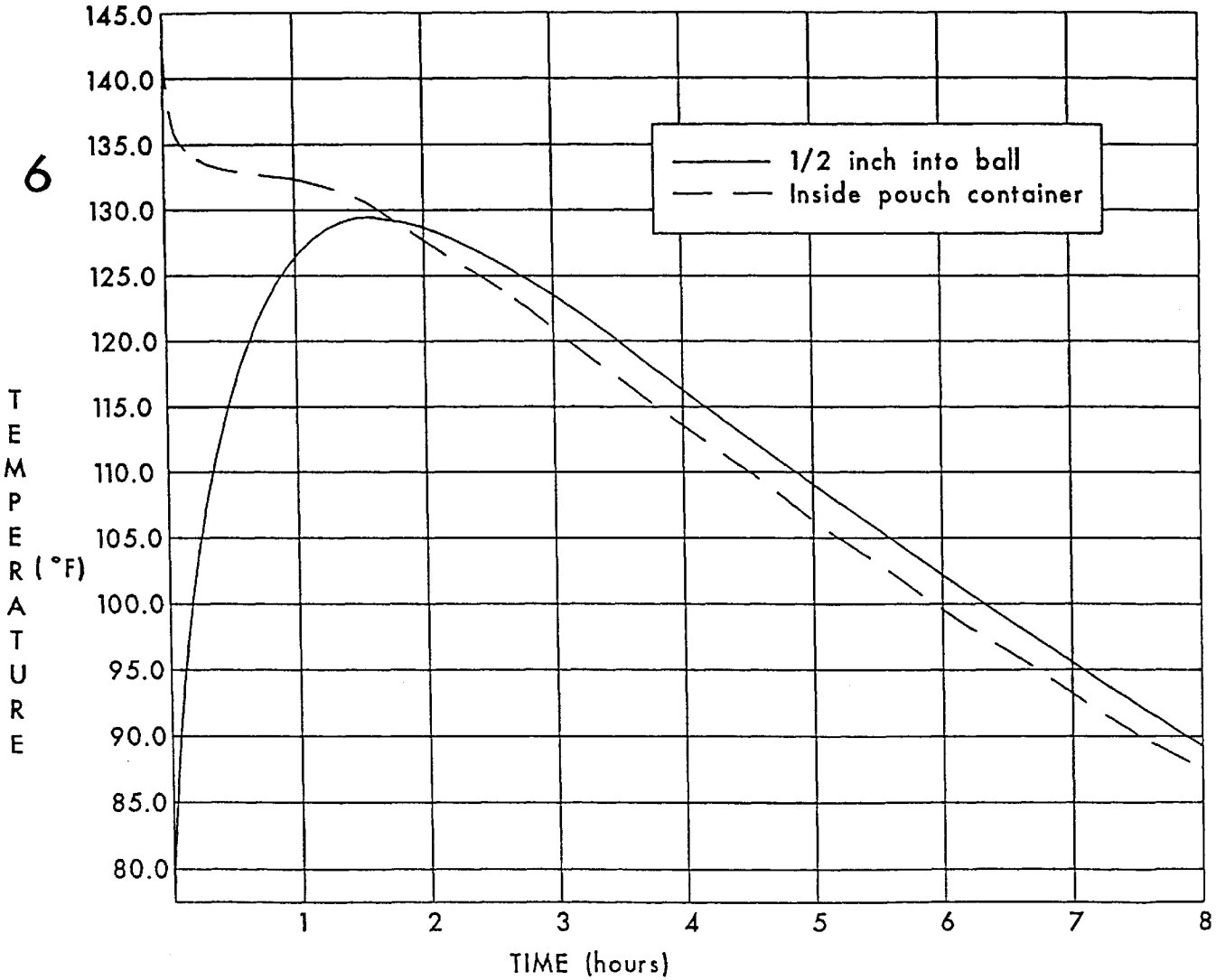
FIG. 6 is a graph illustrating heat loss over time of a golf ball while stored in a ball caddy according to this invention.
Figure 7:
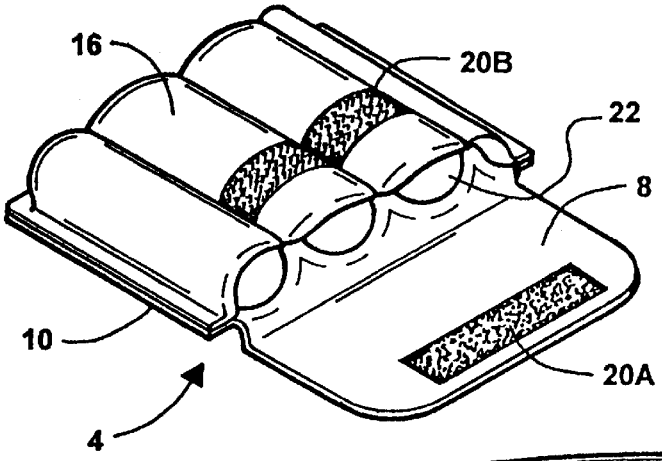
FIG. 7 is a pictorial view of an open pouch according to this invention containing golf balls.

With the balls in the charged pouch and the pouch enclosed in its insulated container, the PCM will give up heat, warming the balls and keeping them warm for several hours as shown in FIG. 6. As the liquified paraffin, or other phase change material, in the PCM starts to return to its solid phase, or freeze (at the elevated temperature range of the PCM), heat is given up. This heat is absorbed by the balls, warming them and keeping them at an elevated temperature. The heat is confined in the insulated container to prolong the effect. As long as some of components of the PCM are still in their liquid phase, the PCM will tend to maintain its temperature. The PCM will start to loose its temperature only after all of the components of the PCM have frozen. The PCM will then slowly cool, depending on the heat lost from the insulating container. The balls, surrounded by the PCM and the insulated container will retain their absorbed heat for many hours.

Figure 5:
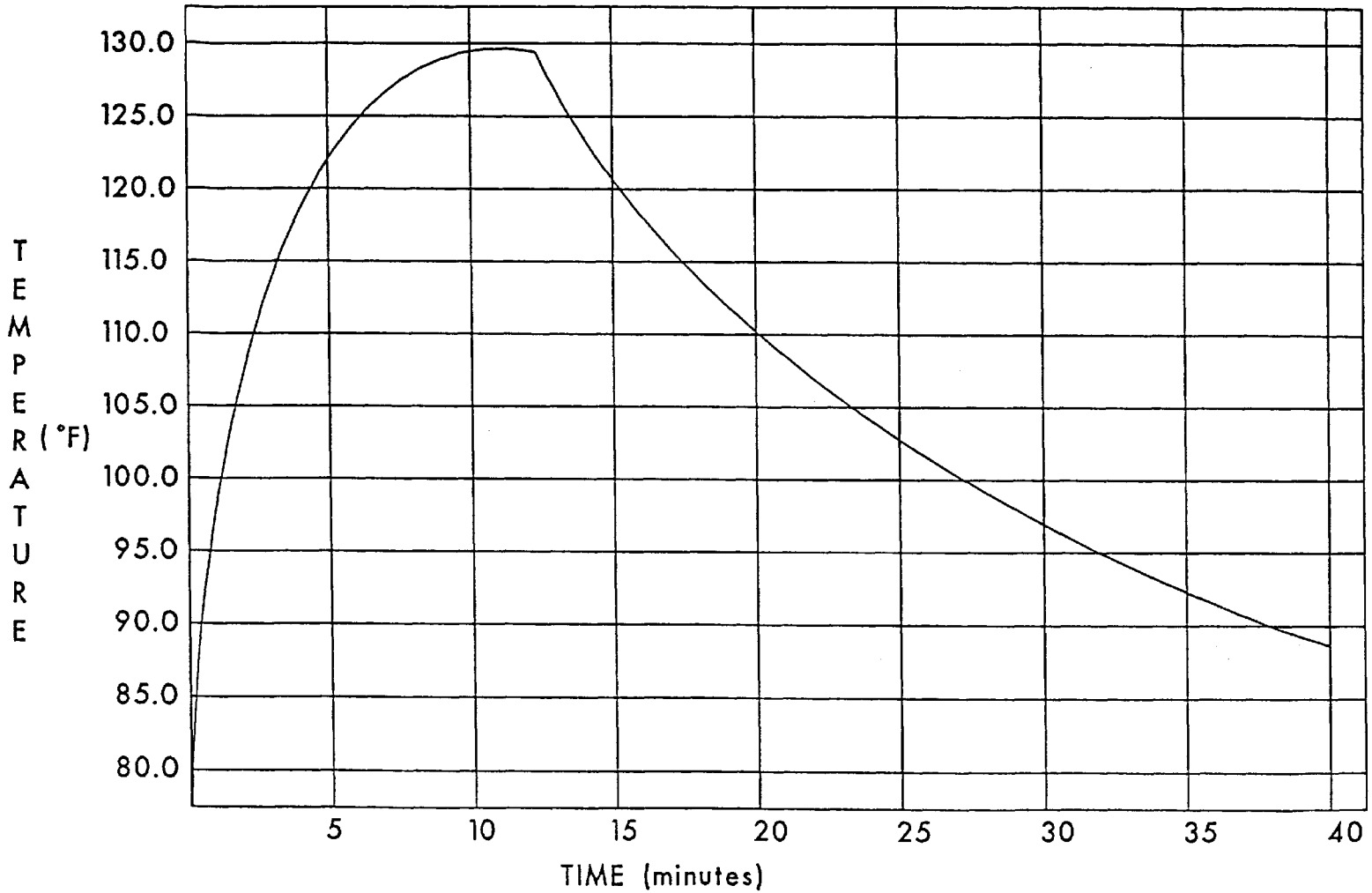
FIG. 5 is a graph illustrating heat loss over time of a golf ball while in a conventionally insulated container.

Referring to FIG. 5, the temperature loss of a golf ball enclosed in only an insulated container is shown in graph form. A golf ball was submerged in water at a temperature of 158° F. for 13 minutes. This heated the ball to approximately 129° F. The ball was immediately transferred to an insulated container, similar to insulated container 6, and the lid was closed. The graph depicts the temperature over time of a point ½ inch into the test golf ball. As can be seen, the ball cooled rapidly. After only 40 minutes, the temperature of the ball had dropped to approximately 88° F. This result shows that simply carrying heated balls in an insulated container is not sufficient to maintain an elevated temperature long enough to use for more than just a couple of holes of golf.

Referring to FIG. 6, the temperature loss of a golf ball enclosed in a charged thermo golf ball caddy 2 of this invention is shown in graph form. A pouch 4, containing 13.6 ounces of PCM, compounded for a temperature range of approximately 145–150° F. was charged in a one kilowatt microwave oven for 3 minutes. A golf ball was inserted in the pouch which was closed and immediately placed into an insulated container 6 according to this invention and the lid was closed. Initially the temperature inside the pouch (dashed line) begins to cool, partly due to the cold golf ball, while the temperature of the golf ball (solid line) increases due to the heat emanating from the PCM mix in the pouch. The PCM tends to maintain a fairly steady temperature of approximately 130–133° F. for just under 2 hours. Then the temperature of the ball and the PCM both slowly drop at an almost linear rate to approximately 88° F. after 8 hours. From this chart it is clear that a golf ball, or balls, can be heated and kept at an elevated temperature long enough to play a full round of golf.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims. For example, while the above description dealt primarily with golf balls, it should be understood that this invention is equally applicable to heating and keeping warm for hours any other kind of ball when it is advantageous to do so. Also the pouch can be used alone without the insulated container, but to achieve a more prolonged effect, the pouch should be carried in the closed container.

I claim:

1. A heat dispensing ball caddy comprising:

(a) compliant means for storing a latent heat of fusion, and (b) means for surrounding a plurality of balls in the compliant means, the compliant means dispensing heat primarily when it undergoes a phase change.

2. The caddy according to claim 1 further comprising thermally insulated means for immediately enclosing the means for surrounding to prolong the dispensing of heat.

3. The caddy according to claim 1 wherein the means for surrounding the plurality of balls comprises a closable pouch including compliant walls, and wherein the compliant means for storing a latent heat of fusion is disposed in the walls.

4. The caddy according to claim 2 wherein the means for surrounding the plurality of balls comprises a closable pouch including compliant walls, and wherein the compliant means for storing a latent heat of fusion is disposed in the walls.

5. The caddy according to claim 3 further comprising means for uniformly distributing the compliant means throughout the walls.

6. The caddy according to claim 5 wherein the compliant walls comprise a plurality of uniform cells, and wherein the compliant means is disposed in the cells.

7. The caddy according to claim 6 wherein the walls are quilted to define the cells.

8. The caddy according to claim 4 further comprising means for uniformly distributing the compliant means throughout the walls.

9. The caddy according to claim 8 wherein the compliant walls comprise a plurality of uniform cells, and wherein the compliant means is disposed in the cells.

10. The caddy according to claim 9 wherein the walls are quilted to define the cells.

11. A heat dispensing golf ball caddy comprising:

(a) compliant means for storing a latent heat of fusion, and (b) means for surrounding a plurality of golf balls in the compliant means, the compliant means dispensing heat primarily when it undergoes a phase change.

12. The caddy according to claim 11 further comprising thermally insulated means for immediately enclosing the means for surrounding to prolong the dispensing of heat.

13. The caddy according to claim 11 wherein the compliant means comprises a powder including a phase change material, and the means for surrounding comprises wall means defining a plurality of cells which contain the power.

14. The caddy according to claim 13 wherein the phase change material includes a paraffin having a selected phase change temperature.

15. The caddy according to claim 14 wherein the paraffin has a melting temperature of about 147° F.

16. The caddy according to claim 13 wherein the phase change material has a phase change temperature within the range of 130°–150° F.

17. The caddy according to claim 13 wherein the phase change material is a gel, and the means for surrounding comprises wall means defining cells which contain the gel.

* * * * *